United States Patent [19]

Stenkvist

[11] 4,016,355

[45] Apr. 5, 1977

[54] DEVICE IN DIRECT CURRENT ARC FURNACES

[75] Inventor: Sven-Einar Stenkvist, Vasteras, Sweden

[73] Assignee: ASEA AB, Vasteras, Sweden

[22] Filed: July 10, 1975

[21] Appl. No.: 594,739

[30] Foreign Application Priority Data

July 23, 1974 Sweden ..... 7409557

[52] U.S. Cl. ..... 13/11

[51] Int. Cl.[2] ..... H05B 7/20

[58] Field of Search ..... 13/11, 18, 9, 12

[56] References Cited

UNITED STATES PATENTS 2,652,440 9/1953 Simmons ..... 13/11

3,683,094 8/1972 Schlienger ..... 13/18

FOREIGN PATENTS OR APPLICATIONS 252,037 5/1926 United Kingdom ..... 13/11

*Primary Examiner*—R. N. Envall, Jr.

*Attorney, Agent, or Firm*—Kenyon & Kenyon Reilly Carr & Chapin

[57] ABSTRACT

The present invention relates to a device in direct current arc furnaces with a furnace vessel and at least one arcing electrode (cathode) and at least one contact electrode. The number of cathodes and/or contact electrodes (for example hearth connections - anodes) may be one, two or more.

4 Claims, 4 Drawing Figures

DEVICE IN DIRECT CURRENT ARC FURNACES

Figure 1:
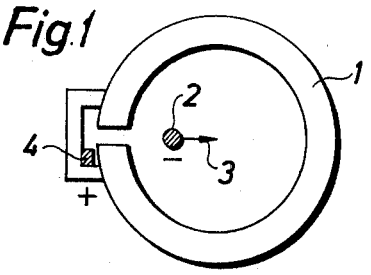

In an arc furnace supplied with direct current where the contact electrode has been placed at the side of the vertical line through the tip of the arc electrode, the arc is influenced by the electromagnetic forces emanating from the current paths in the melt in such a way that the arc does not burn vertically but obliquely from the arc electrode towards the bath in a direction facing away from the contact electrode. This fact results in the disadvantage that the section of the lining in the furnace, towards which the arc has been thus displaced, is exposed to harder stresses and thus harder wear than other parts of the wall of the furnace vessel.

According to a known method the arc may be caused to burn vertically by placing the contact electrode at the vertical line through the tip of the arc electrode, so that the dissymmetry in the current paths which causes the obliquity of the arc does not occur. A disadvantage of this method, however, is that the contact electrode must be placed at the bottom of the furnace at a location which is less favourable from the point of view of lining.

Another known method of balancing the arc so that it will burn vertically is to use two or more contact electrodes which are symmetrically positioned in relation to the arc electrode (cathode). The disadvantage of this is the more complicated furnace construction, and also that it will be difficult to achieve a symmetrical splitting-up of current between the contact electrodes despite a symmetrical location of the electrodes. A slight reduction in resistance of one of the contact electrodes may cause this to take over a greater part of the current so that the arc is again obliquely blown, thus causing the uneven wear on the lining.

According to a third and also well-known method involving symmetrically located contact electrodes, these are connected by turns by means of a switch so that the obliquity of the arc is successively changed, thus spreading the wear on the lining. The disadvantages arising from this method are the complicated construction and the difficulties of operating with switches for the high currents which will be used.

When testing a DC arc furnace it has been observed that the magnetic field from the inductive stirrer very strongly affects the arc. An arc which burnt steadily when the stirrer was disconnected was thrown to and fro concurrently with the frequency of the stirrer when this was switched on. The invention aims at a positive utilization of this very effect. The device according to the invention is characterised in that iron cores are placed at the bottom of the furnace or the furnace vessel, said iron cores being provided with magnetizing windings supplied with direct current or low-frequency alternating current, a magnetic field thus being introduced into the furnace which controls the arc in the desired manner in dependence on the direction and location of the field. By a low-frequency alternating current is meant a frequency below the power frequency, usually below 25 Hz, suitably from 0.1 to 10 Hz. In this way it will be possible to control the arc in such a way that a symmetrical wear on the lining in the furnace vessel and the furnace bottom and also in the furnace roof is obtained. When the iron cores and the coils are correctly positioned, an arc will be obtained which is controlled as desired.

In a preferred embodiment of the invention the cores with magnetizing windings are placed below the bottom of the furnace which is made of a non-magnetic material, the cores being oriented in such a way that the field generated by the control magnet is located substantially perpendicularly to the arc and to the direction in which the arc would tend to become oblique if no control magnet was used. The magnetic law of force (Biot and Savart's law) is utilized, i.e. $\overline{F}=\overline{B}\times\overline{I}$, and it is thus possible to achieve a resulting force $\overline{F}$ in a direction which counteracts the tendency to obliquity of the arc.

Figure 2:
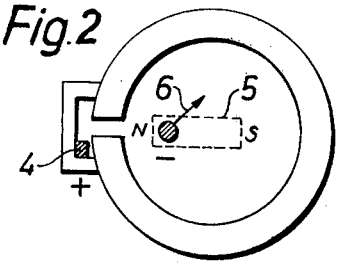
Figure 3:
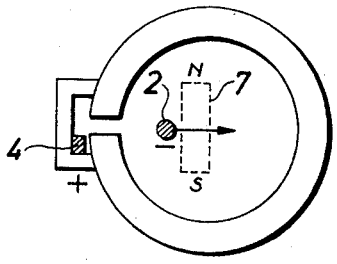

The invention is further exemplified in the accompanying drawing, in which FIGS. 1, 2 and 3 show DC arc furnaces in cross-section.

FIG. 1 shows a device without a control magnet, and FIGS. 2 and 3 show the same device at different locations of the control magnet.

Figure 4:
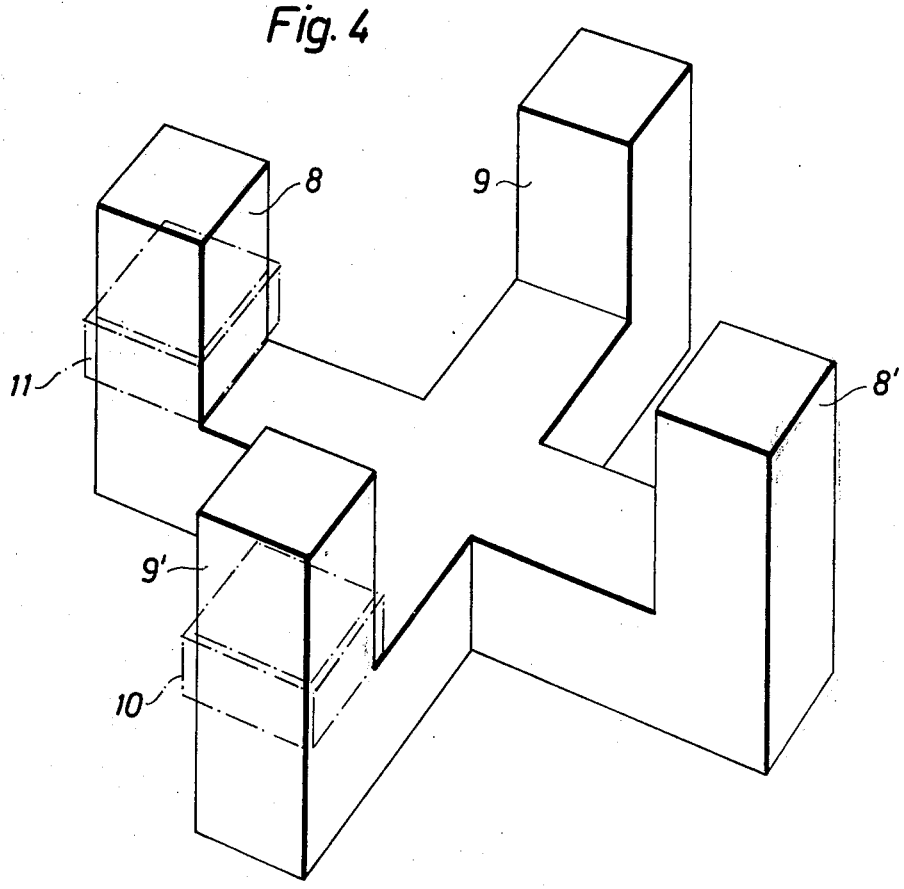

FIG. 4, finally, shows a bottom arrangement of iron cores with coils, intended to be placed below the furnace bottom.

FIG. 1 shows the arrangement of electrodes in an arc furnace supplied with direct current which is not provided with a control magnet. 1 is the vessel of the furnace, seen from above, and this is constructed with a common lining compound. 2 is the graphite electrode, which may also be of the Soderberg type, and this electrode may either be solid or provided with internal feed channels for charge material and additives. In the case according to FIG. 1 the electrode is solid. 4 is a contact electrode, for instance a hearth connection, and this is as usual intended to act as the anode whereas the electrode 2 is the cathode in the furnace. The arc current is supplied at the contact electrode 4, which is connected to positive polarity, the graphite electrode 2 being connected to negative polarity. The magnetic field, arising from the current paths, drives the arc away from the side of the furnace vessel where the current is fed in (see the arrow 3), and the arc will therefore burn from the electrode obliquely downwards-inwards towards the centre of the furnace as indicated in FIG. 1.

If, according to the invention, a device 5 is placed below the furnace bottom or at the side of the furnace, which device generates a magnetic field with a polarity illustrated in FIG. 2 (DC-fed field), also this field will influence the arc and, according to the magnetic law of forces, the arc will be controlled to the side in the way indicated by the arrow 6. A reverse magnetic polarity will, of course, control the arc to the other side. By displacing the core in a suitable manner, it will be possible to obtain a desirable displacement of the resultant for the force which affects the arc. A control field oriented in this manner can not neutralize the obliquity of the arc, but it may be utilized to change the obliquity in one direction or the other, depending on the polarity of the control field. Thus, if a control magnet oriented in this way is fed with a low-frequency alternating voltage, the arc will perform a sweeping movement to and fro, so that the melting and radiation effect is substantially directed towards a sector of the furnace space corresponding to the sweeping movement. This method, therefore, makes it possible to control the wear on the furnace in a suitable manner.

Now, if the control magnet is oriented 90° from the position described above (see FIG. 3), the foot point of the arc on the melt is moved further into the furnace, i.e. the arc is more horizontally directed compared with FIG. 1. If the magnetic polarity in FIG. 3 is changed, the arc will be more vertical, and if the magnetic field from the device below the furnace is stronger than the magnetic field from the arc current, the arc can even be made to point in the other direction, i.e. towards the contact electrode 4.

If the magnetic field resulting from the control magnet has the correct polarity and strength, it will thus be possible to neutralize the magnetic unbalance — which causes the obliquity of the arc — arising from the current paths in the melt, thus achieving a balanced vertical arc. In order to maintain this condition even if the arc current varies it is obviously desirable to control the current source which feeds the control magnet so that the control field always has the right proportion in relation to the arc current. This can be achieved by any conventional method, for example by thyristorcontrolled feeding of the control magnet.

It is also possible now to combine control magnets having the orientation described above in such a way that a crossed core (8, 9, see FIG. 4) is arranged below the furnace bottom, said crossed core being provided with windings (exemplified at 10 and 11) to neutralize the magnetic unbalance resulting from the current paths in the melt, as well as to sweep with the arc, not only across a sector but around the whole furnace. To accomplish this, two opposed legs in the cross (not shown in FIG. 4, but arranged according to FIGS. 2 and 3) can be provided with windings supplied with direct current according to the foregoing, whereas all legs in the cross 8, 8' and 9, 9' (FIG. 4) respectively, are provided with windings supplied with low-frequency alternating current (see 10 and leg 9'), and a corresponding coil (not shown on leg 9) and a winding 11 on the leg 8, and a winding (not shown) on leg 8'. The AC feed is to be two-phase, the two phases being displaced about 90 electric degrees with respect to each other, i.e. one phase for the coil 10 is to be displaced 90° relatively to the phase in the coil 11. Two opposite legs 8, 8' belong to one phase and the two other legs 9, 9' belong to the other phase, and the DC field is achieved in some other way (not shown in FIG. 4).

In the event that two or more symmetrically placed contact electrodes are arranged in the furnace or one contact electrode is arranged at the furnace bottom at the vertical line through the tip of the arcing electrode, the DC control winding may be omitted and it will suffice with the two-phase AC winding to achieve the rotating sweep of the arc.

The advantage of controlling the arc in this way is obvious. The melt-down process can be affected and the wear on the lining can be reduced. The device below the furnace bottom which delivers the control field may be formed in many different ways, depending on the desired attainable effect.

In all cases the bottom of the furnace should be constructed with a lining of a non-magnetic material, such as stainless steel.

If a three-legged core is used, the current feed may be three-phase alternating current.

I claim:

1. A DC electric arc furnace comprising a furnace enclosure having a hearth for containing a melt, said hearth having a contact electrode for the melt, an arcing electrode positioned above the melt for forming an arc with the melt when placed in circuit therewith via said electrode, said arcing and contact electrodes being relatively offset in a horizontal direction so that the arc is normally angularly deflected with respect to a vertical direction, and means for applying a magnetic field to the arc so as to control its arcing direction.

2. The furnace of claim 1 in which said means comprises at least one magnetic core having at least one electrically energized magnetizing coil, the core being positioned below said hearth and the hearth itself being non-magnetic.

3. The furnace of claim 2 in which said core is positioned to form a magnetic field substantially perpendicular to the arc formed by said arcing electrode.

4. The furnace of claim 3 in which a second core forms a cross with said one core and also has at least one electrically energized magnetizing coil.

* * * * *